US007028777B2

(12) United States Patent
Wade et al.

(10) Patent No.: US 7,028,777 B2
(45) Date of Patent: Apr. 18, 2006

(54) OPEN WATER RUNNING TOOL AND LOCKDOWN SLEEVE ASSEMBLY

(75) Inventors: Morris B. Wade, Houston, TX (US); Gregory D. Williams, Houston, TX (US); Lionel J. Milberger, Houston, TX (US); Timothy A. Pillow, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 157 days.

(21) Appl. No.: 10/689,505

(22) Filed: Oct. 16, 2003

(65) Prior Publication Data

US 2004/0238175 A1 Dec. 2, 2004

Related U.S. Application Data

(60) Provisional application No. 60/419,399, filed on Oct. 18, 2002.

(51) Int. Cl.
*E21B 29/12* (2006.01)

(52) U.S. Cl. ..... 166/343; 166/348; 166/341; 166/85.1

(58) Field of Classification Search ..... 166/368, 166/348, 343, 341, 338, 365, 386, 334.4, 166/85.1
See application file for complete search history.

(56) References Cited

U.S. PATENT DOCUMENTS

| | | | | |
|---|---|---|---|---|
| 4,938,289 | A * | 7/1990 | Van Bilderbeek | 166/342 |
| 5,791,418 | A * | 8/1998 | Milberger et al. | 166/368 |
| 6,129,149 | A * | 10/2000 | Beall | 166/344 |
| 6,227,300 | B1 * | 5/2001 | Cunningham et al. | 166/339 |
| 6,557,638 | B1 * | 5/2003 | Cunningham et al. | 166/348 |
| 6,640,902 | B1 * | 11/2003 | Baten et al. | 166/368 |
| 2004/0140124 | A1 * | 7/2004 | Fenton et al. | 175/7 |

* cited by examiner

*Primary Examiner*—Thomas A Beach
(74) *Attorney, Agent, or Firm*—Browning Bushman P.C.

(57) ABSTRACT

A running tool 10, a lockdown sleeve 27, and a seal ring 24 are provided for axially fixing upward movement of a tubular hanger with respect to a subsea wellhead. The running tool 10 includes a tool latching and unlatching mechanism 51 for axially connecting the running tool to the subsea wellhead housing, a tool force applicator 64 for exerting a downward setting force, and a sleeve latching mechanism 73 for securing the lockdown sleeve to the subsea wellhead housing 20. The seal 24 is provided between the lockdown sleeve and one of the tubular hanger and the wellhead housing. The method of the invention includes running the tool and sleeve in open water to the subsea wellhead housing, locking the tool to the housing, setting the seal, locking the sleeve to the housing, then retrieving the tool in open water.

34 Claims, 7 Drawing Sheets

OPEN WATER RUNNING TOOL AND LOCKDOWN SLEEVE ASSEMBLY

RELATED APPLICATIONS

The present application claims priority from U.S. Ser. No. 60/419,399 filed on 18 Oct. 2002.

FIELD OF THE INVENTION

The present invention relates to lockdown sleeves of the type commonly used in oilfield operations for preloading wellhead components into the bottom of a subsea wellhead. More particularly, the present invention relates to an improved running tool for locking an improved lockdown sleeve in place.

BACKGROUND OF THE INVENTION

By landing on the last casing hanger and locking into the subsea wellhead running profile, or into the horizontal tree grooves, the lockdown sleeve (LDS) preloads all of the wellhead components into the bottom of the wellhead. This minimizes the stress induced from thrust loads and thermal loads on the wellhead system throughout the life of the system, and increases the useful service life. An LDS with a seal has been set using a drilling riser with extreme weight or hydraulic pressure from the BOP stack, as discussed below.

The LDS is typically run through the riser and landed on the top of the upper casing hanger. The rams on the BOP are closed to apply pressure to the LDS seal. After the LDS is landed, pressure is applied and the seal is tested from above. Then hydraulic pressure is applied to the drill pipe to actuate a sleeve on the running tool that locks the LDS to the wellhead. The rams are opened and the running tool is removed by a straight pull which shears spring loaded shear pins.

The lockdown sleeve or LDS is used to lock down the casing hanger from thermal growth and protect the bore of the casing head in the event of drilling through it. The preferred LDS has a seal on the lower end and a seal pocket in the upper end along with a shear pin groove for attachment of the running tool. The LDS has typically been run inside the BOP via the running tool.

Another LDS tool is run in open water by drill pipe without a BOP stack. By running on drill pipe, the weight to set the seal is significant. To achieve this weight without hydraulic pressure, drill collars may be added to the drill pipe string above and below the running tool to achieve the weight needed to set the seal. After the seal is set, the LDS may be locked by hydraulic pressure applied via the drill pipe to the running tool to lock the LDS to the wellhead housing. After the LDS is locked in place, pressure may be applied to test the LDS seal from below. The seals in the running tool and the cup tester have the same diameter and are pressure balanced. Once the seal has been tested, the running tool may be removed by shearing the shear pins for retrieval with straight pull.

The LDS running tool may be attached by shear pins in a groove above the seal pocket in the upper end of the LDS. The running tool may have lock, unlock and test functions. A test sub may be attached at the bottom of the tool for testing the seal along with the test cup for sealing in the upper casing hanger and casing.

The cost of running the LDS inside the BOP is very high and takes a dedicated riser and drilling vessel. Although the LDS may be run on drill pipe, this would also take a dedicated vessel and drill pipe, and this technique takes extreme weight to set the seal. To achieve this weight, heavy and expensive drill collars are added to the string.

There is thus a need for an improved running tool for use with a lockdown sleeve to preload wellhead components into the bottom of a subsea wellhead.

SUMMARY OF THE INVENTION

A running tool and lockdown sleeve assembly are provided for axially fixing upward movement of a tubular hanger, such as a casing hanger, with respect to a subsea wellhead housing. In a suitable embodiment, the casing hanger is connected to a casing string extending downward from the subsea wellhead housing into the well, with the subsea wellhead housing including an outer latching profile. The assembly comprises a running tool including (a) a tool latching and unlatching mechanism for axially connecting and disconnecting the running tool to the subsea wellhead housing, (b) a tool force applicator for exerting a downward setting force after the tool latching member connected to the subsea wellhead housing, and (c) a sleeve latching applicator for moving a sleeve latching mechanism. The assembly further comprises a lockdown sleeve having generally cylindrical outer surface and a central bore, with a lockdown sleeve carrying a sleeve latching mechanism moveable in response to the sleeve latching applicator for axially connecting the lockdown sleeve to the subsea wellhead housing, and a seal for sealing between the lockdown sleeve and one of the casing hanger and the wellhead housing in response to the downward force.

It is a feature of the invention that the seal may be set by downward motion of the lockdown sleeve relative to the wellhead housing.

Another feature of the invention is that the tool latching and unlatching mechanism effects radial movement between latched and unlatched positions in response to axial movement of an actuator within the running tool.

In a preferred embodiment, the seal is carried to the subsea wellhead housing on a lower end of the lockdown sleeve, while the sleeve latching mechanism is provided at the upper end of the lockdown sleeve.

In a preferred embodiment, the running tool is hydraulically actuated, but the tool could be configured for a mechanical actuation, e.g., by an ROV. The tool may be lowered into the well from wireline, but may also be positioned with respect to the wellhead housing by an ROV, or may be lowered from a tubular string.

In a preferred embodiment, the seal includes a metal-to-metal seal, and optionally an elastomeric backup seal. The lockdown sleeve preferably has an inner profile for receiving a latching mechanism of another tool, and may also include a sealing profile for sealing engagement with a sealing member positioned within the sleeve.

According to the method of the invention, the lockdown sleeve is fixed with respect to a subsea wellhead housing to prevent upward movement of a tubular hanger with respect to the wellhead housing. The method comprises providing a running tool, a lockdown sleeve, and a seal, and includes lowering the running tool, the lockdown sleeve, and the seal in open water to a subsea wellhead housing, locking the tool to an outer latching profile of the subsea wellhead housing, applying a downward force to set the seal, latching the sleeve to the wellhead housing, and retrieving the tool with the sleeve fixed to the subsea wellhead housing.

According to a preferred embodiment, the tool latching and unlatching mechanism effects a radial movement between latched and unlatched positions in response to axial movement of an actuator. The seal is preferably set by downward motion of the lockdown sleeve relative to the wellhead housing. In a suitable embodiment, the tool is hydraulically actuated and includes a fluid passageway through the running tool for testing the integrity of the seal and for relieving fluid pressure.

A significant advantage of the tool and the method is that high costs involved with a dedicated vessel and with expensive drill strings collars are avoided.

A further advantage of the invention is that the components of the invention are highly reliable and may be manufactured on an economical basis.

These and further features and advantages of this invention will become apparent from the following detailed description, wherein reference is made to the figures in the accompanying drawings.

DETAILED DESCRIPTION OF PREFERRED EMBODIMENTS

Figure 1:
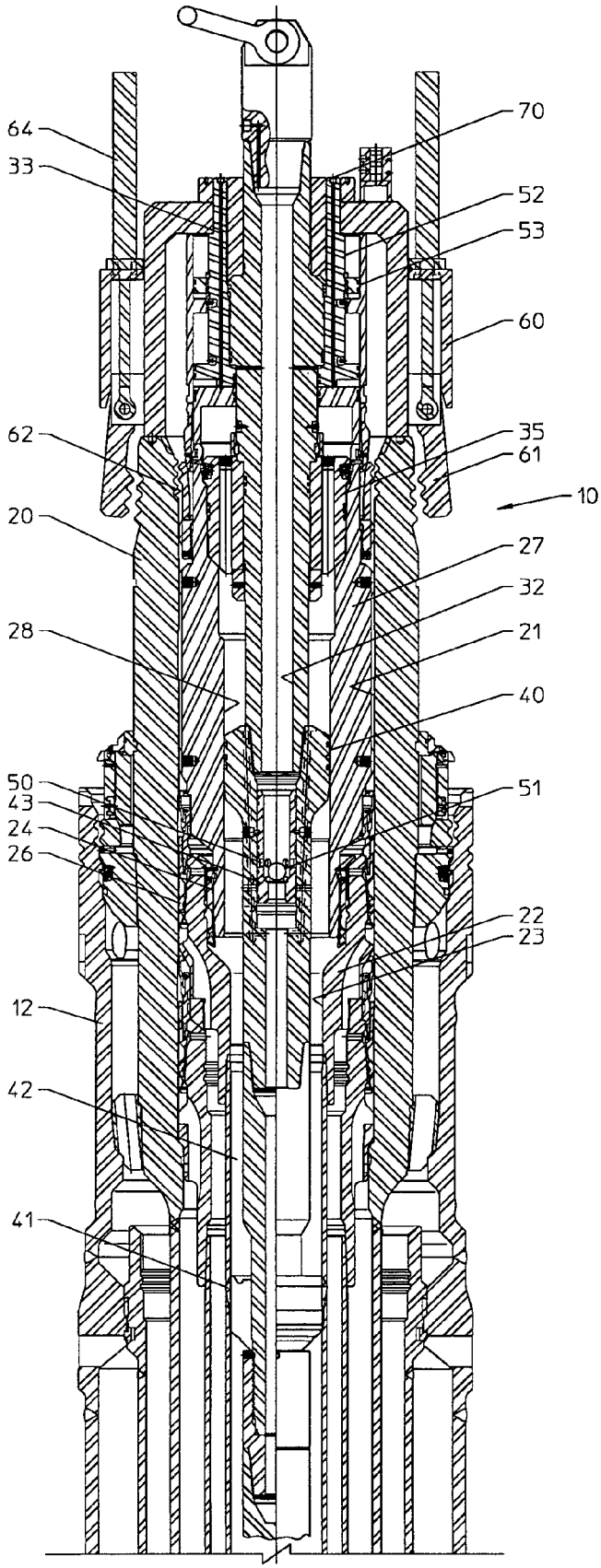
FIG. 1 is a cross-sectional view of a running tool and lockdown sleeve positioned on a subsea wellhead.

By landing on the last casing hanger and locking into the subsea wellhead running profile, or into the horizontal tree grooves, the lockdown sleeve (LDS) preloads all of the wellhead components into the bottom of the wellhead. This minimizes the stress induced from thrust loads and thermal loads on the wellhead system throughout the life of the system, and increases the useful service life. A preferred LDS incorporates a tieback profile and a running groove near the top. A seal ring may be mounted on the OD of the LDS to seal against a shoulder on the casing hanger to isolate the production casing bore from the rest of the wellhead components.

In accordance with this invention, the LDS may be run in open water without a riser system or BOP stack and may be landed, locked and tested in open water. The open water running tool (OWRT) has a latching mechanism that axially locks the tool to the OD of the subsea wellhead housing. This latching function may be actuated by hydraulic pressure to cylinders that move a sleeve over a locking device, such as dogs, a split ring, or shear pins. The running tool may have an internal piston that will set the LDS seal without the need for a BOP to lockdown the LDS, then enable retrieval of the LDS.

Hydraulic functions may be supplied to the tool by an ROV, umbilical or mechanically actuated. The OWRT may be run on wireline cable, drill pipe or with an ROV, and preferably includes a test sub connected to the bottom to seal in the LDS and a cup tester to seal in the upper casing hanger or casing to allow the test to be made from below.

The lower end of the LDS has a metal-to-metal seal to provide an annular seal between the casing hanger and the LDS. A sealing profile and running groove are provided in the upper end of the LDS, as well as a seal pocket for a tieback connector, horizontal trees and spools. The running groove receives shear pins to hold the LDS to the running tool, and a locking ring on the outside of the upper end is actuated by a wedge ring to lock the LDS to the ID of the wellhead.

With reference now to the details of the attached drawings, a wellhead 20 having a bore 21 therethrough has casing hangers mounted therein to suspend concentric casings within the wellbore. The innermost casing is suspended from an uppermost casing hanger 22. The hanger has a bore 23 therethrough whose upper end carries a seal ring 24 having an upper face on the upper end of its inner cylindrical portion. Another seal ring 26 is carried about the upper end of the casing hanger to seal between it and the bore of the wellhead. A conductor housing 12 has an outer tubular extending downward with one or more intermediary tubulars between the outer conductor and the casing string.

As shown in FIG. 1, a lockdown sleeve (LDS) 27 has been lowered by means of a running tool into the bore 21 of the wellhead above the uppermost casing hanger and seal ring 24. The LDS has a bore 28 therethrough and a lower end extending within the upper end of the bore 23 of the hanger 22, when the running tool has landed on the upper end of the wellhead.

Figure 2:
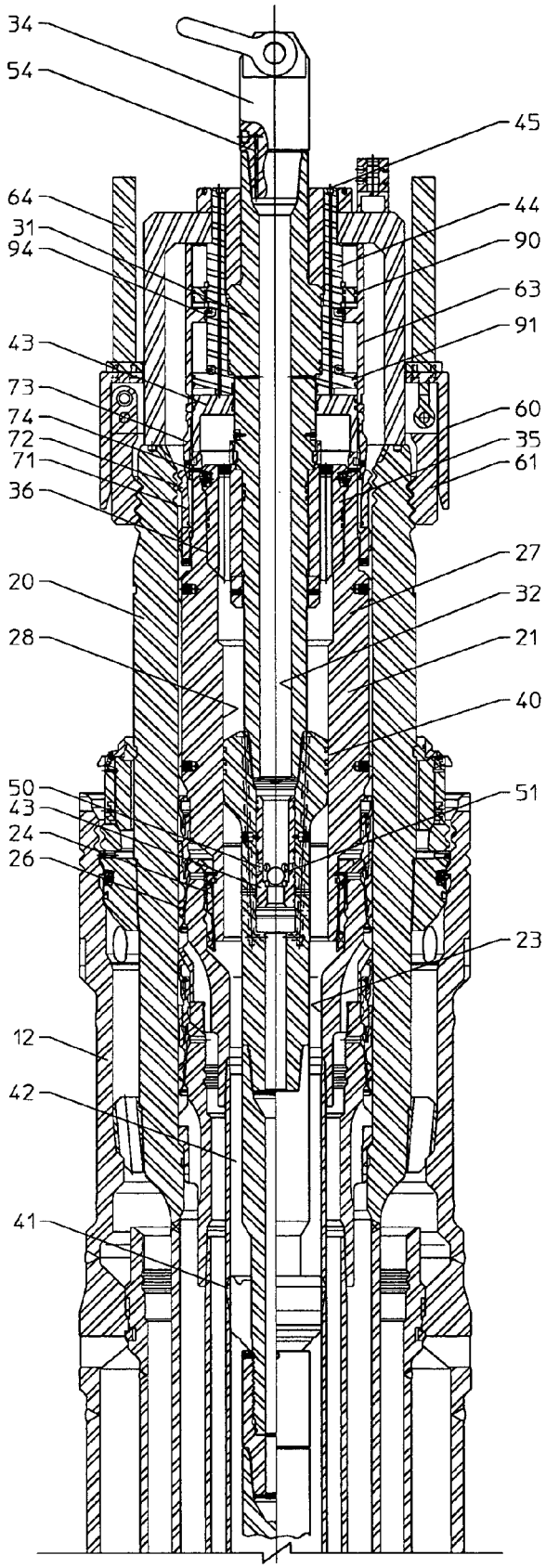
FIG. 2 illustrates the tool axially secured to the subsea wellhead.

Latches 61 are pivotally mounted about the running tool 10 for swinging between outer positions (as shown in FIG. 1) in which they may be lowered over the upper end of the wellhead, i.e., subsea wellhead housing 20, when the running tool is landed on the upper end of the wellhead, and an inner latching position with latches 61 within grooves 62 about the wellhead by means of a sleeve 60 carried about the lower end of an actuator 64, as shown in FIG. 2. Actuator 64 may comprise circumferentially spaced hydraulic cylinders with extend and retract rods to connect and disconnect the latches 61 with housing 20. In this position of the running tool, the lower tapered end of the LDS is above the seal 24 mounted on the upper end of the innermost casing hanger.

The running tool has an elongate tubular body 31 (see FIG. 2) whose bore 32 has a lower closed end 33 and an upper end 34 which may be suspended from a cable or wire. The running tool body also has an intermediate enlargement 35 which is supported on the lower end of a recess 36 in the bore of the LDS, and is ported to permit fluid to bypass therethrough. A lower enlargement 40 of the tool body is sealably engaged within the bore 28 of the LDS, and a cup or packer 41 is carried about the running tool beneath the enlargement 40 to form an annular space 42 between them.

Figure 3:
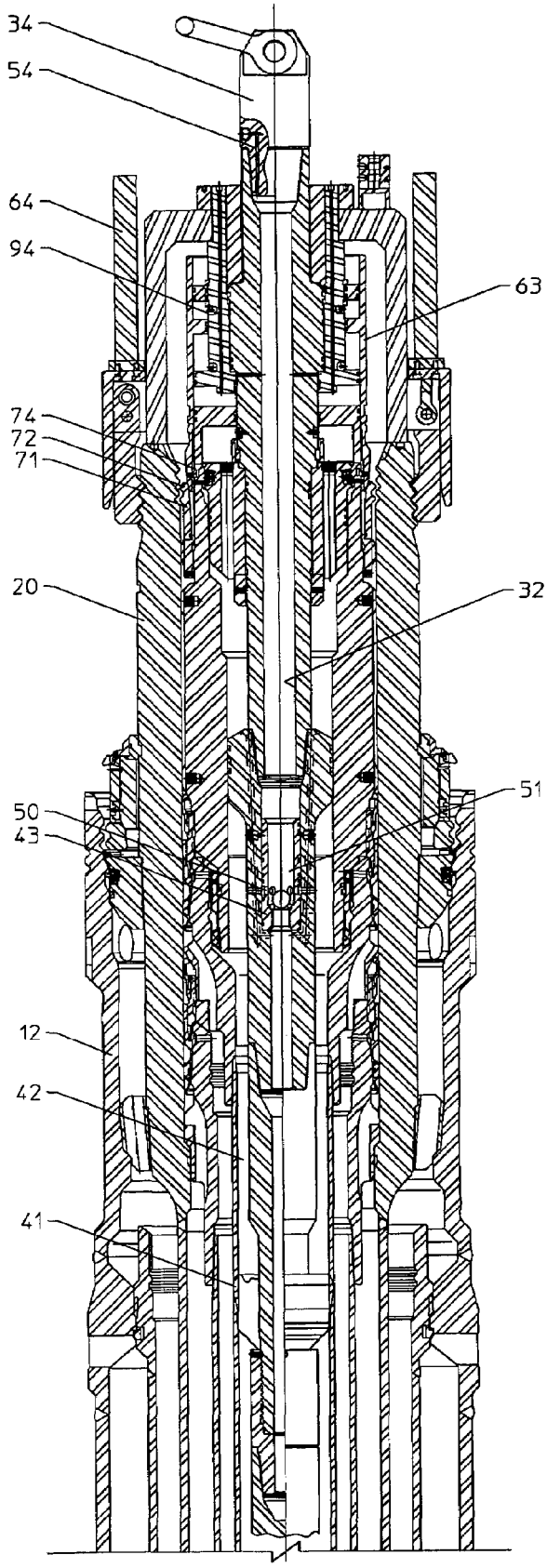
FIG. 3 illustrates the lockdown sleeve lowered to energize the seal ring.

A piston 43 is carried about the body of the running tool above the upper end of the LDS for reciprocation between the upper position of FIGS. 1 and 2 and the lower position of FIG. 3 to activate seal 24 and preload the LDS. The piston is beneath a manifold 44 about the running tool body and within a sleeve 63 thereabout sealably slidable about the running tool body. A passageway 45 is formed in the manifold to receive fluid pressure from an external source which is applied to a chamber beneath the manifold and above the piston to lower it and thereby lower the LDS as shown in FIG. 3 to set the seal 24 and preload the LDS.

The running tool manifold also has upper and lower pistons 90 and 91 sealably slidable within sleeve 63 above and below an intermediate piston 94 within the sleeve 63.

The piston 94 is adapted to be lowered by the introduction of fluid from an outside source to and from chambers above and below it, as may be seen from comparison of FIGS. 2 and 3.

Figure 4:
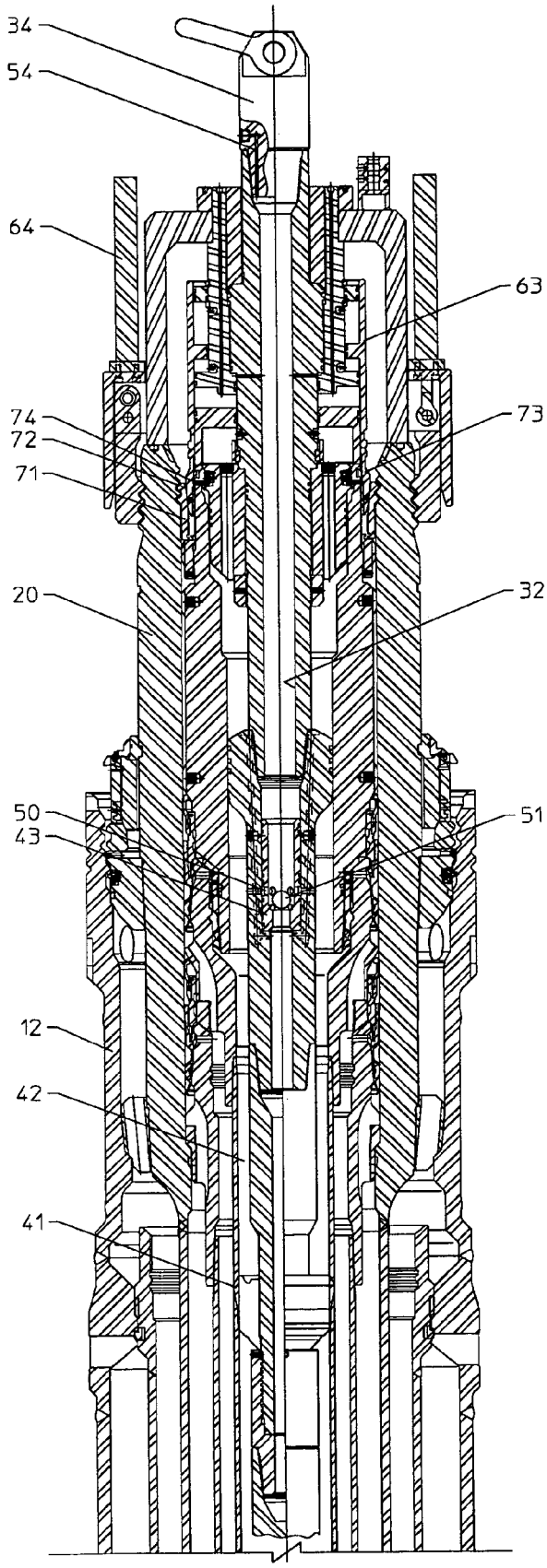
FIG. 4 illustrates the lockdown sleeve locked to the subsea wellhead housing.

A split lock ring 71 as shown in FIG. 3 is carried about the LDS with its teeth opposite grooves 72 in the upper end of the wellhead bore. A wedge ring 73 is releasably connected to the LDS by shear pins 74 about the upper end of the LDS with its lower end within the upper end of the split lock ring. Sleeve 63 is above the wedge ring 73 in position to lower the wedge ring within the lock ring to shear the pins and cause its teeth to engage the grooves within the wellhead body, as shown in FIG. 4. A wedge ring may thus serve as a sleeve latching applicator, with split lock ring 71 serving as a sleeve latching mechanism. Other mechanical designs may be used for both the sleeve latching mechanism and the latching applicator.

A ball 51 seated in the bore of sleeve 43 prevents communication between ports 50 in the sleeve 43 and ports in the running tool. As will be described, and as shown in FIG. 3, fluid pressure supplied to the bore 32 of the running tool body through port 54 will shear pins holding the sleeve in its upper port closing position, and thus permit the ball 51 to lower the sleeve to align the ports in the sleeve with the ports in the running tool so that the fluid pressure will enter the space 42 about the running tool between the enlargement 40 and the packer 41 to test the sealing integrity of seal 24 when lowered to close the space between the lockdown sleeve 27 and the uppermost casing hanger 22.

Prior to setting of seal 24, fluid pressure may be introduced into the bore 32 through the running tool to lower the ball in the sleeve 43 and thereby permit test fluid to be introduced into the annular space between the enlargement about the running tool and the cup shaped packer about its lower end. A passageway 80 formed through the running tool will vent pressure within the lower end of the bore through the running tool as the sleeve is lowered. The introduction of this test pressure will permit the operator to verify that the seal has been established between the LDS 27 and the uppermost casing hanger 22 and the running tool prior to setting of the sleeve.

Figure 5:
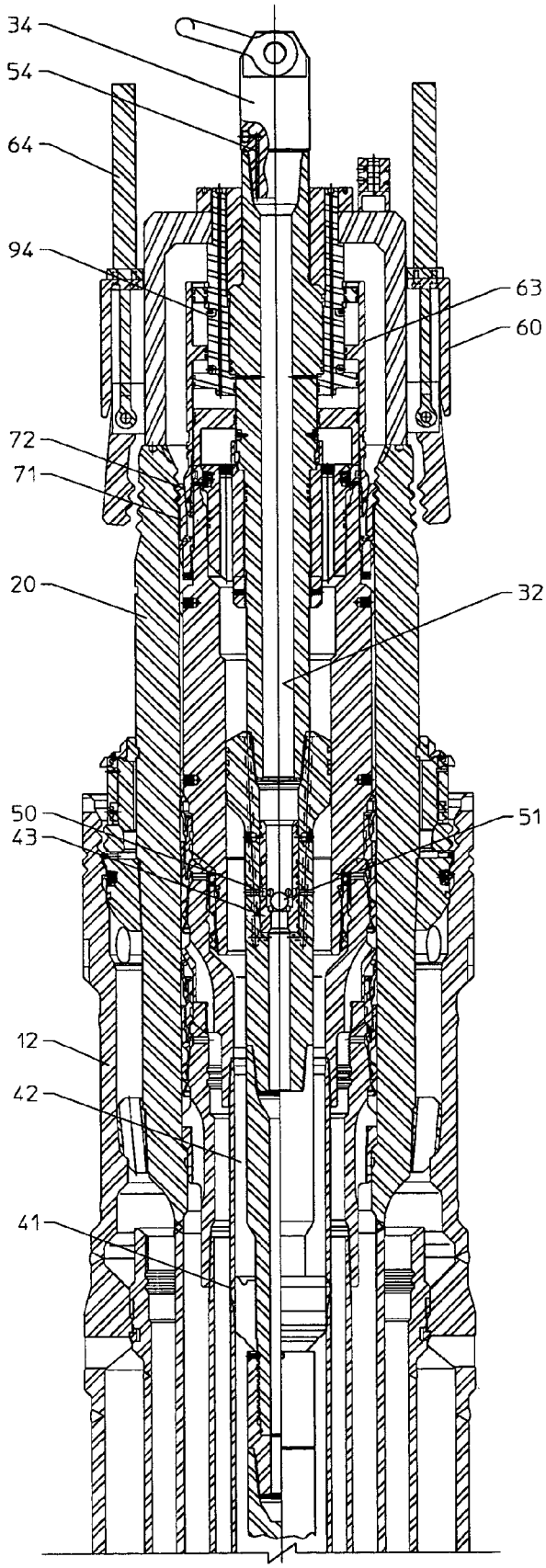
FIG. 5 illustrates the running tool unlocked from the wellhead housing.
Figure 6:
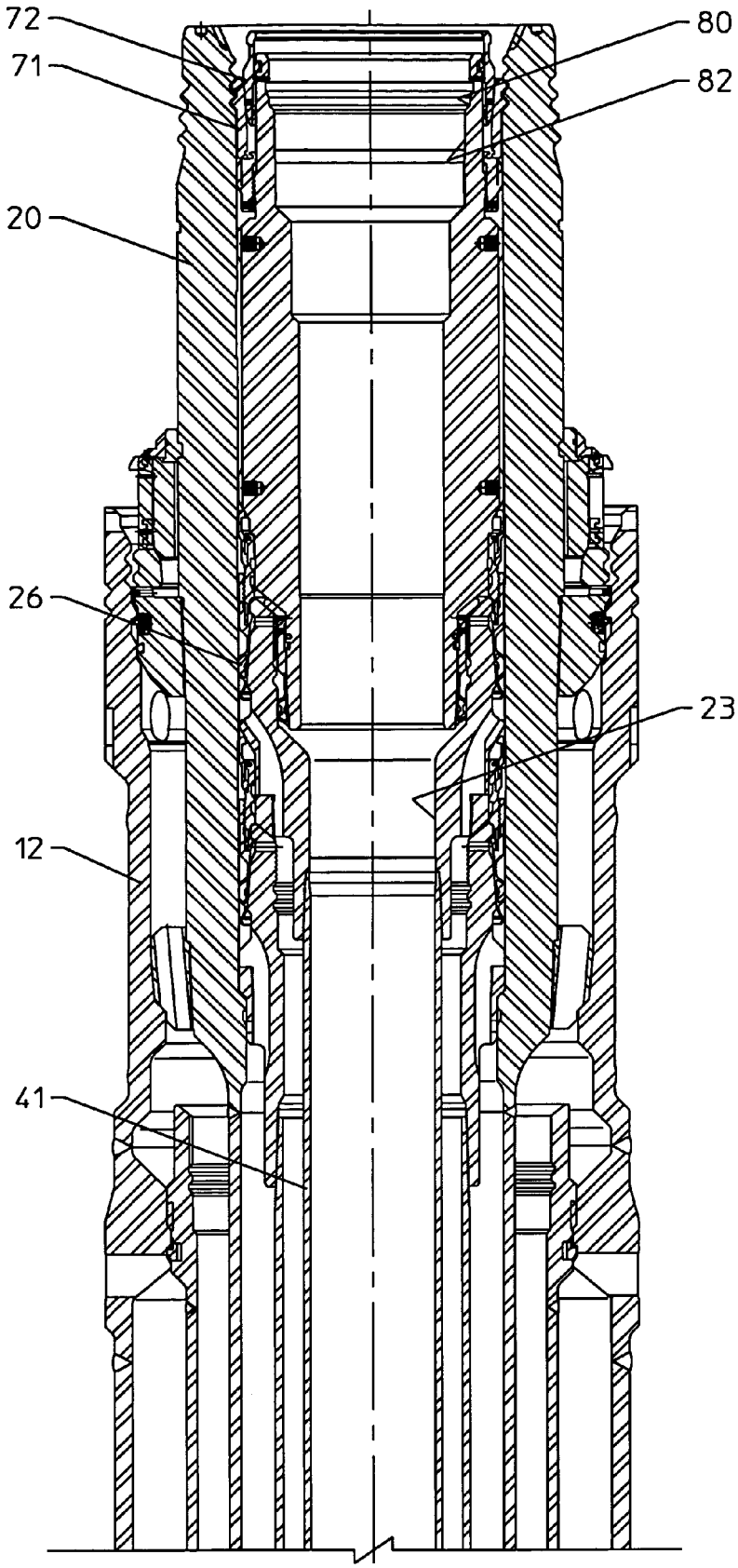
FIG. 6 illustrates the running tool removed and the lockdown sleeve positioned above the casing hanger.

If the test confirms that the seal between the LDS and casing hanger holds, the sleeve 60 may be raised to move the latches 61 to unlatching position as shown in FIG. 5, so as to permit the running tool to be raised from the LDS, as the LDS remains in locked down position, as shown in FIG. 6. Upon raising of the running tool, the enlargement about its intermediate portion as well as the cup packer near its lower closed end may be raised, thus enabling drilling to be performed through the wellhead. The lockdown sleeve preferably includes an inner profile 80 to receive a latching member from another tool and a sealing surface 82 for sealing engagement with a tool positioned within the lockdown sleeve.

To summarize the method of the invention, upon latching of the running tool is the LDS, as shown in FIG. 3, piston 60 of the running tool is lowered, as shown in FIG. 2, to in turn lower the LDS, set seal 24 and preload the LDS. Ball 51 is then lowered as also shown in FIG. 3 to permit the sealing integrity of seal 24 to be tested. As shown in FIG. 4, sleeve 63 is lowered to shear the pins 74 to release the running tool from the LDS and lower the wedge ring into the locking ring to move it into grooves in the wellhead. As shown in FIG. 5, the running tool may then be unlatched from the LDS to permit it to be raised from the LDS, as shown in FIG. 6.

Figure 7:
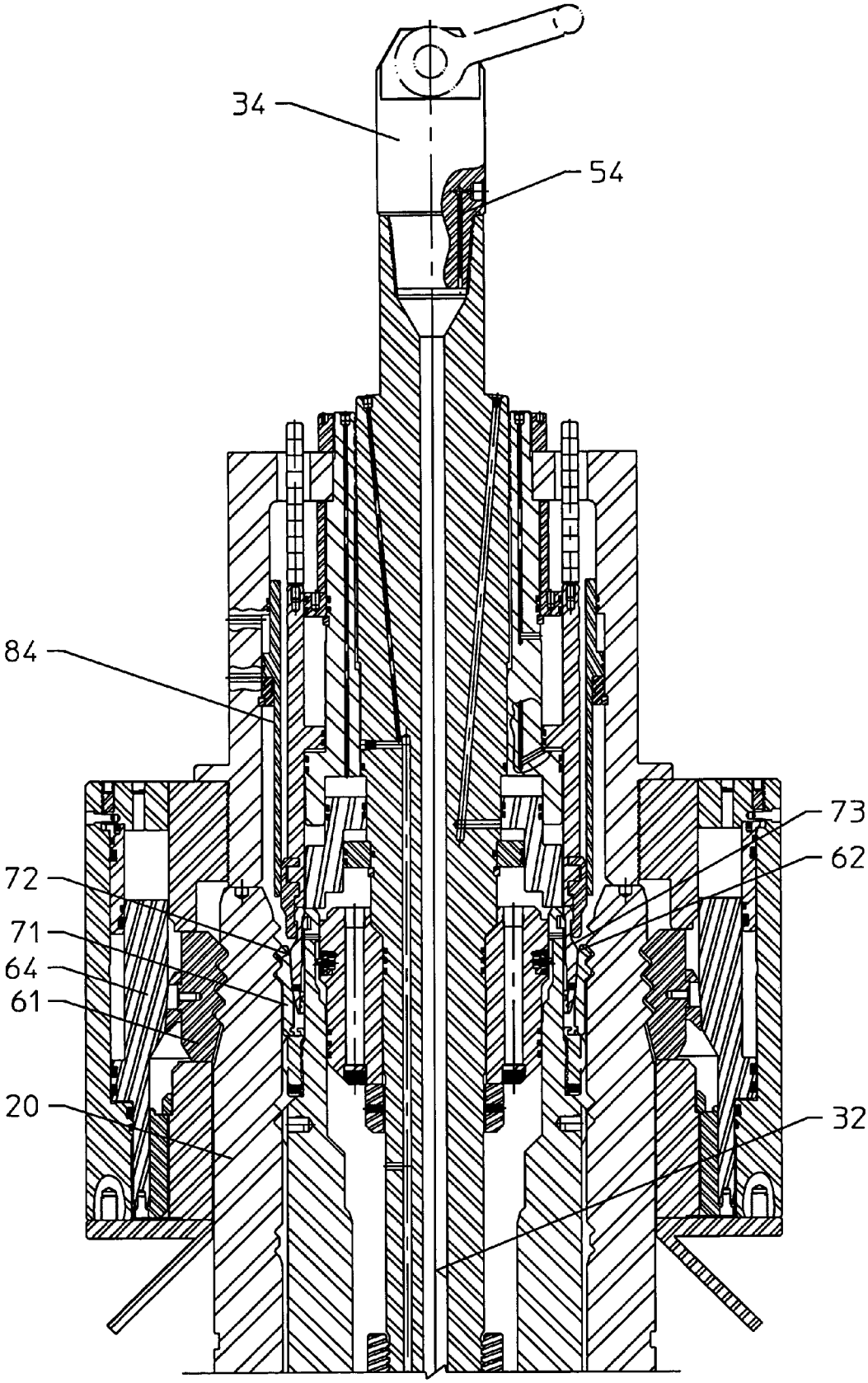
FIG. 7 illustrates an alternative arrangement for axially securing the running tool to the subsea wellhead.

FIG. 7 illustrates an alternative arrangement for an upper portion of the running tool, with an alternative mechanism for connecting and disconnecting the running tool from the subsea wellhead. In FIG. 7, the same reference numerals are used to depict components with functions similar to those shown in FIGS. 1-6. In this embodiment, an annular piston 64 may be activated to guide latch member 61 inward for locking engagement with the wellhead housing 20. Piston 64 in turn may be housed within a locking housing, which conveniently may be threaded at the outer portion of the running tool body 31. The design as shown in FIG. 7 includes an additional double acting piston 84 which allows the optional retrieval of the lockdown sleeve without requiring a trip to the surface of the OWRT.

A suitable running sequence for the tool is set forth below.

Running Sequences for Open Water LDS Running Tool:

1. Install OWRT in LDS.
2. Hook up running equipment (cable, drill pipe or ROV).
3. Lower assembly to wellhead.
4. Once the LDS and OWRT are landed the hydraulic pressure is applied to the tool lock port, this locks OWRT to wellhead.
5. Hydraulic pressure is applied to the set port; this sets the LDS seal and releases the tool from the running profile.
6. The seal is tested.
7. Lock down the LDS via hydraulic ports.
8. Unlock OWRT from wellhead and retrieve.
9. Completed well.

While the running tool, the lockdown sleeve, and seal as disclosed herein may conveniently be lowered in open water to a subsea wellhead housing, components may otherwise be positioned in place above the wellhead housing. A tether and ROV may be used, for example, to position the running tool and lockdown sleeve on a subsea wellhead housing. A work string could also be used to position the running tool and sleeve subsea.

In a preferred embodiment, the running tool provides downward motion of the lockdown sleeve which then sets the seal. In other embodiments, the running tool could connect to the subsea wellhead housing and position the lockdown sleeve in place, then slide a seal down the lockdown sleeve to set the seal. One disadvantage of this procedure is that, if the seal is not properly made up, the lockdown sleeve may have to be disconnected from the subsea wellhead.

In a preferred embodiment, the seal 24 is carried to the subsea wellhead housing on a lower end of the lockdown sleeve, and a sleeve latching mechanism is provided at the upper end of the lockdown sleeve. The running tool disclosed herein may be hydraulically actuated, but the running tool could be mechanically actuated, e.g., in response rotation of a hex stud by an ROV, a piston or ram could be forced downward, thereby providing the desired force to both set the seal and lock the sleeve to the subsea wellhead. Another alternative would be to provide hydraulic connections between the running tool and the ROV to move a piston axially within the ROV to set the seal and/or connect the sleeve to the wellhead housing.

In a preferred embodiment, axial movement of a piston within the running tool latches the lockdown sleeve to the wellhead, although other arrangements could be made for latching the running tool to the outer profile of a subsea wellhead. A lockdown sleeve may also have an inner profile for receiving a latching mechanism from another tool, and may also include a sealing profile for sealing engagement with a sealing member positioned within the sleeve. The seal ring itself preferably includes a metal-to-metal seal, but may also include one or more elastomeric seals.

The foregoing disclosure and description of the invention is illustrative and explanatory of preferred embodiments. It would be appreciated by those skilled in the art that various changes in the size, shape of materials, as well in the details of the illustrated construction or combination of features discussed herein maybe made without departing from the spirit of the invention, which is defined by the following claims.

The invention claimed is:

1. A running tool and lockdown sleeve assembly for axially fixing upward movement of a tubular hanger with respect to a subsea wellhead housing, the tubular hanger connected to a tubular string extending downward from the subsea wellhead housing into the well, the subsea wellhead housing including an outer latching profile, the assembly comprising:

the running tool including (a) a tool latching mechanism for axially connecting the running tool to the outer latching profile on the subsea wellhead housing, (b) a tool force applicator for exerting a downward setting force on a seal after the tool latching mechanism connects the tool to the subsea wellhead housing, and (c) a sleeve latching applicator for moving a sleeve latching mechanism;

a lockdown sleeve having a generally cylindrical outer surface and a central bore, the sleeve latching mechanism moveable in response to the sleeve latching applicator for axially connecting the lockdown sleeve to an internal profile in the subsea wellhead housing thereby fixing upward movement of the tubing hanger with respect to the wellhead housing; and the seal sealing between the lockdown sleeve and one of the tubular hanger and the wellhead housing in response to the downward force.

2. The assembly as defined in claim 1, wherein the tool latching mechanism effects radial movement between latched and unlatched positions in response to axial movement of an actuator.

3. The assembly as defined in claim 1, wherein the seal is set by downward motion of the lockdown sleeve relative to the subsea wellhead housing.

4. The assembly as defined in claim 1, wherein the seal is carried to the subsea wellhead housing on a lower end of the lockdown sleeve.

5. The assembly as defined in claim 1, wherein the sleeve latching mechanism is provided at an upper end to the lockdown sleeve.

6. The assembly as defined in claim 1, wherein the running tool is hydraulically actuated.

7. The assembly as defined in claim 1, wherein the subsea wellhead housing includes an inner profile to receive the sleeve latching mechanism to axially connect the lockdown sleeve to the wellhead housing.

8. The assembly as defined in claim 1, wherein the sleeve latching mechanism is a split ring.

9. The assembly as defined in claim 1, wherein the running tool includes a packer and a fluid passageway for testing sealing integrity of the seal.

10. The assembly as defined in claim 1, wherein an axially moveable piston within the running tool moves the latching applicator to connect the lockdown sleeve to the subsea wellhead housing.

11. The assembly as defined in claim 1, wherein the seal includes a metal-to-metal seal.

12. The assembly as defined in claim 1, wherein the seal includes an elastomeric seal.

13. The assembly as defined in claim 1, wherein the lockdown sleeve has an inner profile for receiving a latching mechanism from another tool.

14. The assembly as defined in claim 13, wherein the sleeve includes a sealing profile for sealing engagement with a sealing member positioned within the sleeve.

15. The assembly as defined in claim 1, wherein a tubular hanger is a casing hanger.

16. A running tool and lockdown sleeve assembly for axially fixing upward movement of a casing hanger with respect to a subsea wellhead housing, the casing hanger connected to a casing string extending downward from the subsea wellhead housing into the well, the subsea wellhead housing including an outer latching profile, the assembly comprising:

the running tool including (a) a tool latching mechanism for axially connecting the running tool to the outer latching profile on the subsea wellhead housing, (b) a tool force applicator for exerting a downward setting force on a seal after the tool latching mechanism connects the tool to the subsea wellhead housing, and (c) a sleeve latching applicator for moving a sleeve latching mechanism;

a lockdown sleeve having a generally cylindrical outer surface and a central bore, the sleeve latching mechanism movable in response to the sleeve latching applicator for axially connecting the lockdown sleeve to an internal profile in the subsea wellhead housing; and the seal sealing between the lockdown sleeve and the tubular hanger in response to the downward setting force.

17. The assembly as defined in claim 16, where the seal is carried to the subsea wellhead housing on a lower end of the lockdown sleeve.

18. The assembly as defined in claim 16, wherein the sleeve latching mechanism is provided at an upper end of the lockdown sleeve.

19. The assembly as defined in claim 16, wherein the running tool is hydraulically actuated.

20. The assembly as defined in claim 16, wherein the subsea wellhead housing includes an inner profile to receive the sleeve latching mechanism to axially connect the lockdown sleeve of the wellhead housing.

21. The assembly as defined in claim 16, wherein the sleeve latching mechanism is a split ring.

22. The assembly as defined in claim 16, wherein the running tool includes a fluid passageway through the running tool for relieving fluid pressure.

23. The assembly as defined in claim 16, wherein an axially moveable piston within the running tool moves the latching applicator to connect the lockdown sleeve to the subsea wellhead housing.

24. The assembly as defined in claim 16, wherein the seal includes a metal-to-metal seal.

25. The assembly as defined in claim 16, wherein the lockdown sleeve has an inner profile for receiving a latching mechanism from another tool.

26. A method of fixing a lockdown sleeve to a subsea wellhead housing for axially fixing upward movement of a tubular hanger with respect to the subsea wellhead housing, the tubular hanger connected to a tubular string extending downward from the subsea wellhead housing into the well, the subsea wellhead housing including an outer latching profile, the method comprising:

providing a running tool including (a) a tool latching and unlatching mechanism for axially connecting the running tool to the outer latching profile on the subsea wellhead housing, (b) a tool force applicator for exerting a downward selling force on a seal after the tool latching mechanism connects the tool to the subsea wellhead housing, and (c) a sleeve latching applicator for moving a sleeve latching mechanism;

providing a lockdown sleeve having a generally cylindrical outer surface and a central bore;

providing the seal for sealing between the lockdown sleeve and one of the tubular hanger and the wellhead housing in response to the downward force; and lowering the running tool, the lockdown sleeve and the seal in open water to the subsea wellhead housing;

locking the tool to the outer latching profile of the wellhead housing;

applying the downward setting force to set the seal;

moving the sleeve latching mechanism to latch the lockdown sleeve to an inner profile in the wellhead housing; and retrieving the tool to the surface with the lockdown sleeve fixed to the subsea wellhead housing.

27. The method as defined in claim 26, wherein the tool latching and unlatching mechanism effects radial movement between latched and unlatched positions in response to axial movement of an actuator.

28. The method as defined in claim 26, wherein the seal is set by downward motion of the lockdown sleeve relative to the subsea wellhead housing.

29. The method as defined in claim 26, wherein the seal is carried to the subsea wellhead housing on a lower end of the lockdown sleeve.

30. The method as defined in claim 26, wherein the running tool is hydraulically actuated.

31. The method as defined in claim 26, wherein the running tool is lowered to the wellhead housing on a wireline.

32. The method as defined in claim 26, wherein the running tool is lowered into the well by an ROV.

33. The method as defined in claim 26, wherein the running tool includes a packer and a fluid passageway for testing sealing integrity of the seal pressure.

34. The method as defined in claim 26, wherein the sleeve has an inner profile for receiving a latching mechanism from another tool.

* * * * *